US006012712A

United States Patent [19]

Bernstein

[11] Patent Number: 6,012,712

[45] Date of Patent: Jan. 11, 2000

[54] DOUBLE VISE WITH SELF-SETTING CLAMPING WITH THE SAME OR DIFFERENT SIZE WORKPIECES

[75] Inventor: Leon M. Bernstein, Minnetonka, Minn.

[73] Assignee: Kurt Manufacturing Company, Inc., Fridley, Calif.

[21] Appl. No.: 09/097,250

[22] Filed: Jun. 12, 1998

Related U.S. Application Data

[60] Provisional application No. 60/078,924, Mar. 20, 1998.

[51] Int. Cl.[7] ..... B25B 1/20

[52] U.S. Cl. ..... 269/43; 269/254 CS; 269/242; 269/160; 269/279

[58] Field of Search ..... 269/43, 242, 244, 269/279, 154, 246, 282, 150, 160, 170, 254 R, 254 CS

[56] References Cited

U.S. PATENT DOCUMENTS

| | | | |
|---|---|---|---|
| 983,131 | 1/1911 | Gannoe | 269/246 |
| 1,753,924 | 4/1930 | Gordon | 269/246 |
| 2,247,656 | 7/1941 | Friedrich | 269/242 |
| 4,529,183 | 7/1985 | Krason et al. | 269/43 |
| 4,934,674 | 6/1990 | Bernstein | 269/242 |
| 5,022,636 | 6/1991 | Swann | 269/43 |
| 5,098,073 | 3/1992 | Lenz | 269/43 |
| 5,458,321 | 10/1995 | Durfee, Jr. | 269/43 |
| 5,649,694 | 7/1997 | Buck | 269/43 |
| 5,683,077 | 11/1997 | Fink et al. | 269/242 |
| 5,720,476 | 2/1998 | Swann et al. | 269/244 |
| 5,806,841 | 9/1998 | Hebener | 269/20 |

*Primary Examiner*—David A. Scherbel
*Assistant Examiner*—Lee Wilson
*Attorney, Agent, or Firm*—Westerman. Champlin & Kelly, P.A.

[57] ABSTRACT

A double vise using a single actuating screw with a self-setting preload arrangement includes a vise base, a center fixed jaw and a pair of movable jaws which are movable toward and away from the center fixed jaw. The movable jaws being actuated with the vise screw. The loads on the vise screw from the jaws being reacted initially by springs that apply a resilient preload against a workpiece in either one of the movable jaws. One jaw is driven with a sleeve rotatably mounted on a cylindrical section of the vise screw and driven through a load release clutch. The springs are mounted on a vise screw support housing that is slidably mounted on the vise base and which provides automatic adjustment of the vise jaws to clamp different size workpieces in the jaws. The sleeve has a threaded section for operating one of the jaws.

26 Claims, 10 Drawing Sheets

DOUBLE VISE WITH SELF-SETTING CLAMPING WITH THE SAME OR DIFFERENT SIZE WORKPIECES

CROSS REFERENCE TO RELATED PROVISIONAL APPLICATION

This application claims priority on provisional application Ser. No. 60/078,924, filed Mar. 20, 1998 for DOUBLE VISE WITH SELF-SETTING PRELOAD.

BACKGROUND OF THE INVENTION

The present invention relates to a machine vise that will clamp two workpieces against oppositely facing surfaces of a center-mounted fixed vise jaw and which is self setting for clamping the same size or different size parts, and which will exert a preload on the parts.

Vises that use a center fixed block mounted on a body and movable jaws that move toward and away from the fixed block for holding or clamping parts has been shown in various forms in the prior art. For example, U.S. Pat. No. 62,584 shows a vise type member, that uses a cam to move outer jaws in toward a fixed center jaw. U.S. Pat. Nos. 5,098,063 and 4,934,674 also show double jaw vises.

SUMMARY OF THE INVENTION

The present invention relates to a machine vise which has a vise body with a fixed center jaw block and having simultaneously movable jaws at opposite ends of the body and with a preload applying block. An actuator or drive is operated to cause the movable jaws to move toward the center block and clamp workpieces on opposite sides or faces of the fixed center jaw block.

The preload block holds the machine vise screw. When the size of the part or workpiece changes, the preload block slides as guided on the vise body and is held by friction in the position which accommodates the new parts. This provides automatic set up for the parts in the jaws which are the same size, or different size. There is no need for operator adjustment. Each set of jaws will adjust to clamp on the part being held regardless of the size of the part in the other set of jaws.

An operator has only two hands so when using a double vise, and a screw actuator, only one hand is available for positioning the workpieces or parts. Thus, when a preload will be provided on one workpiece the operator can position that workpiece, preload it by turning the screw so it is held in position, and then position the other part for final clamping.

Rotation of the vise screw with right and left-hand threads for the respective movable jaws, simultaneously moves the jaws in opposite directions, that is, either toward or away from the center fixed jaw. The preload block has an axial spring load arrangement, which will provide a preload on parts, whether they are positioned between the front movable jaw and the center block (the front jaw set) or the rear movable jaw and the center block (the rear jaw set).

The spring loading arrangement provides for a reasonable amount of travel for the spring preloading.

The amount of travel for the preloading also can be adjusted so that when parts which have a small deviation in size are positioned, the preload travel can be reduced so that once a preload is applied to one part, there does not have to be a great deal of movement of the screw for final tightening of both parts.

DETAILED DESCRIPTION OF THE PREFERRED EMBODIMENTS

Figure 2:
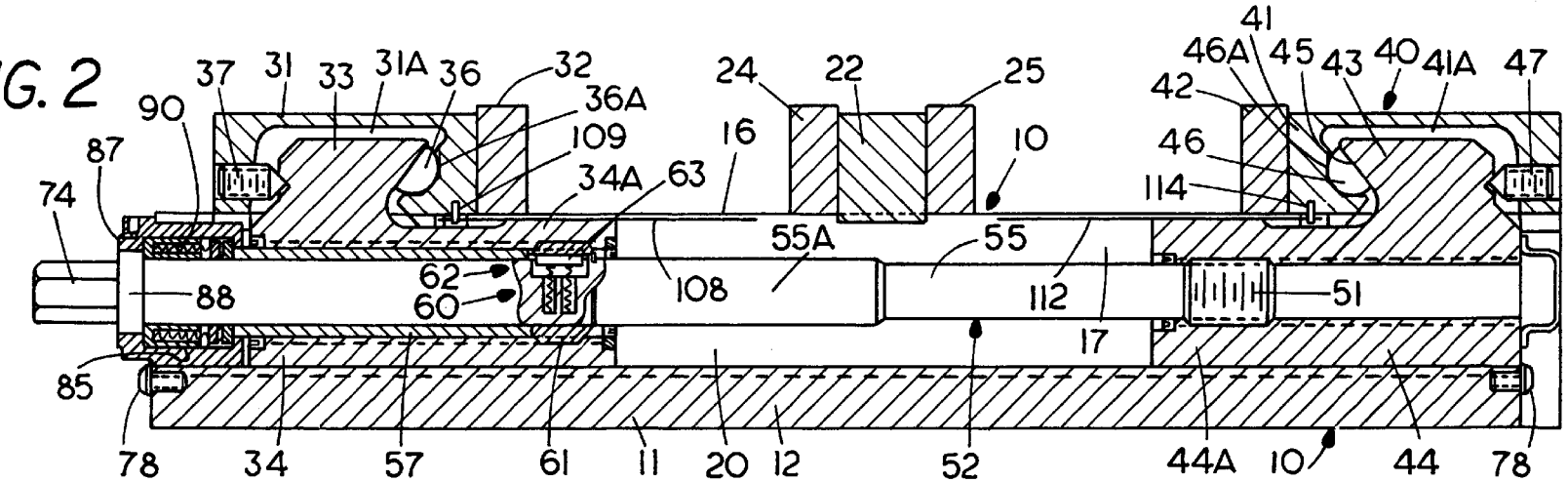
FIG. 2 is a sectional view taken as on line 2—2 in FIG. 1.
Figure 7:
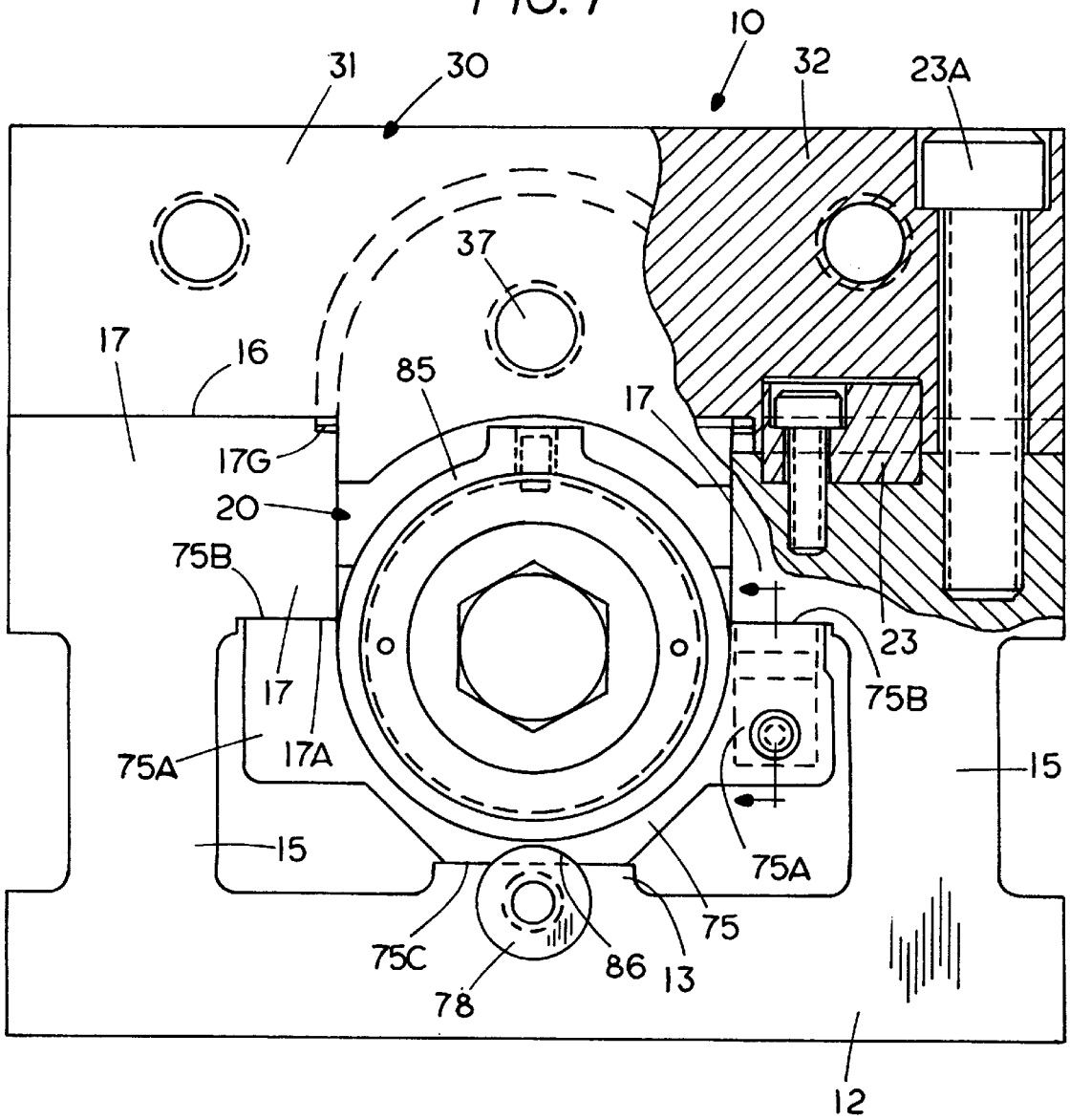
FIG. 7 is an end view taken on line 7—7 in FIG. 4.

A two-station, single action vise indicated generally at 10 comprises a vise body 11 that extends longitudinally. The body has a base plate or wall 12 that has a central rail 13 that forms a guideway for movable parts as will be explained. The body 10 as shown in FIGS. 2 and 7 has side walls indicated at 15 and the side walls have upper vise body ways or rails 17 that form guideway or way surfaces 16 on opposite sides of the body, which are spaced apart and are coplanar. The way surfaces 16 extend along the length of the body and they are flat and parallel. A slot is formed between these surfaces 16. The side walls 15 and rail portions 17 define a channel 20 that extends along the length of the vise. The channel 20 is open at the top and will be shielded by sheet metal plates, as will be explained.

The rail portions 17 support a centrally located fixed jaw assembly indicated generally at 21, which as shown includes a fixed jaw block 22 supporting oppositely facing jaw plates 24 and 25. The jaw plates are fixed to the block 22. As shown in FIG. 7, the block 22 has a key or lug 23 that fits into a circular access groove 23B on one rail portion 17. The key or lug 23 has a narrow center rib 23C that fits into a circular recess in the bottom of block 22. This holds the fixed jaw block 22 in a known lateral position. Fixed jaw block 22 can be fastened to the rail portions 17 in any desired manner and is held in recesses in the rail portion 17 shown in FIG. 2 for reacting clamping forces. For example, as shown, cap screws 23A can pass down through the block and tighten the block against the recess in the tops of the rail portions 17. The center plane of the fixed jaw block 22 is substantially midway between the opposite ends of the vise body. The block 22 provides oppositely facing, fixed vise jaws.

There are a pair of movable jaws in the vise body 11, one adjacent each of the opposite ends. The movable jaws are each made in two parts, as is well known. At the first or front end of the vise body there is a first movable jaw 30, which has a first movable jaw body or block 31 carrying a jaw plate 32, which faces the jaw plate 24 of the fixed jaw. The jaw block 31 is actuated through a movable jaw nut 34 that has a head portion 33 which fits into an interior recess 31A of the jaw body 31. The head portion 33 has an inclined surface that acts to move the movable jaw body 31 through a hemispherical segment 36 and is seated in a complimentary shaped seat 36A in the jaw body 31 to transfer motions tending to clamp the first movable jaw 30 against a workpiece between the movable jaw and the jaw plate 24. A set screw 37 is threaded into the rear wall of the jaw block 31 and bears against the rear surface of head 33 to retain the movable jaw block 31 in position on the head and to permit the threaded portion 34A move the jaw block 31.

A back or second movable jaw assembly 40 is at an opposite or back (distal) end of the vise body 11 and operates in the same manner as the first jaw assembly 30. The second movable jaw assembly 40 includes a jaw block or body 41 which carries a second movable jaw plate 42. A second movable jaw nut 44 is made in the same manner as the previously explained nut 34 and includes a hub 44A that is internally threaded, but is threaded with the opposite hand or lead from the hub 34A. The back or second movable jaw nut 44 includes an inclined surface 45 which bears against a part spherical or hemispherical member 46 that in turn fits into a complimentary shaped receptacle 46A on an end interior surface of a recess 41A of the jaw body 41.

The actuator for the two movable jaws, namely the front and rear jaws as described, is specifically a vise screw or shaft assembly 52 has a threaded section 51 that threads into the interior of the hub portion 44A along a threaded bore 50. The vise screw assembly 52 is rotatably mounted relative to the vise body 11, and the back or second jaw nut 40 moves when the vise screw assembly 52 is rotated, to move the jaw toward or away from the fixed jaw assembly 21 and specifically toward and away from the fixed jaw plate 25.

A suitable seal 53 is provided at an inner end of the jaw nut 44 to engage the cylindrical unthreaded surface of the cylindrical shaft portion 55 of the vise screw assembly 52. The shaft portion 55 includes a larger diameter section 55A that is also smooth and cylindrical.

The front jaw is driven in a manner that will permit a preload to be provided automatically by either one of the front or rear jaws 30 or 40. The hub 34A has an internal threaded section or bore indicated generally at 58 which fits around the cylindrical screw shaft portion 55A. A snap ring 59 is provided on the shaft portion 55A on the interior end of the hub 34A of the front jaw, to prevent a spacer sleeve 57 assembly, including an axial, load carrying sleeve 57A and a clutch sleeve section 61, from sliding past the snap ring.

The vise screw assembly 52 is a jaw drive member and includes the elongated spacer sleeve section 57A, which slides over the cylindrical shaft portion 55A of the vise screw assembly 52. The spacer sleeve section 57A abuts a threaded clutch sleeve section 61. The clutch sleeve section 61, as shown, is a separate ring that also slides over shaft portion 55A, and which engages and drives the internal threads 58 of the hub 34A. The clutch sleeve section 61 is driven from the cylindrical shaft portion 55A through a clutch assembly indicated generally at 60, which in turn then controls the load for driving of the nut 34 for the front jaw. The threaded clutch sleeve section 61 is of opposite hand or lead from the threaded section 51 for driving the rear jaw, so that when the screw assembly 52 is rotated in one direction, both the front and rear movable jaws will be moved toward the center fixed jaw 22, and when rotated in an opposite direction, both of the movable jaws will be moved away from the center fixed jaw 22. The sleeve assembly 57 can be made as one piece.

The release clutch assembly 60 is provided for driving the nut 34 of the front movable jaw 30 until forces (torque) exceed a predetermined amount, after which the release clutch assembly 60 will release and permit the threaded section 51 for the rear jaw to be driven through the cylindrical shaft portion 55 while the spacer sleeve 57A and threaded clutch sleeve section 61 for the front jaw do not rotate. Release clutch assembly 60 in this form of the invention also permits some sliding of the spacer sleeve 57A and threaded clutch sleeve section 61 relative to the vise screw portion 55A for permitting having a preload on the rear jaw. The threaded clutch sleeve section 61 can be formed integral with spacer sleeve section 57A, if desired.

Figure 3:
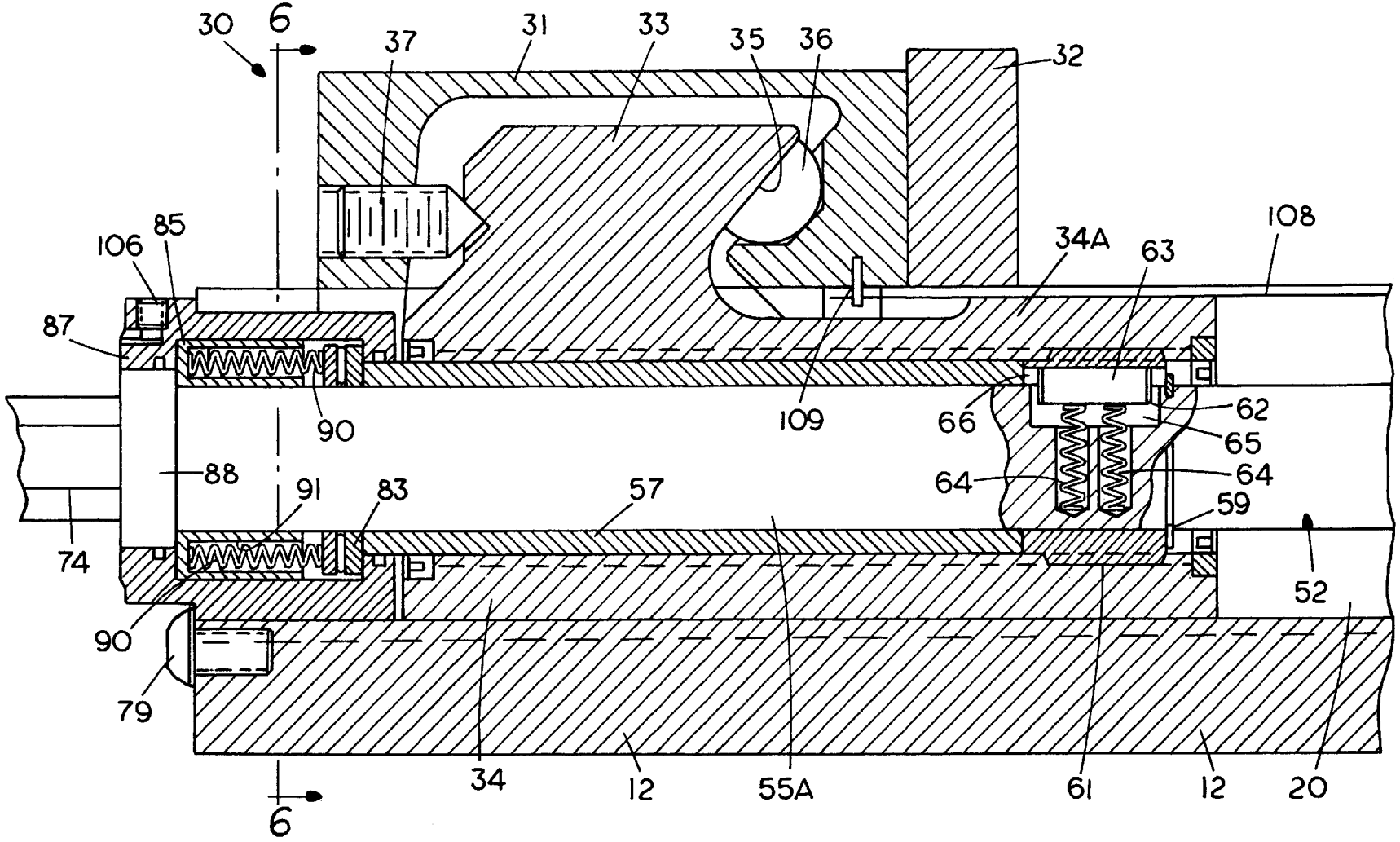
FIG. 3 is an enlarged sectional view of a spring preloading end of the vise screw, including a clutch that is used with the jaws for final tightening.
Figure 8:
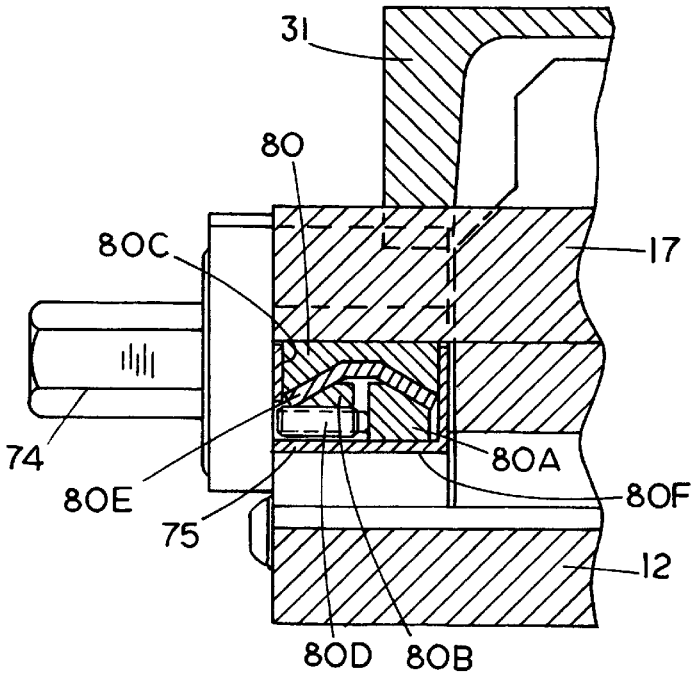
FIG. 8 is a fragmentary sectional view taken on line 8—8 in FIG. 7.

Referring to FIGS. 2, 3 and 8 the clutch or release detent means that are shown at 62 comprise a spring loaded detent member 63 which is a small cylindrical shaft that seats into a spline like recess 65 formed in the threaded clutch sleeve section 61, and this recess is of sufficient length to accommodate some axial sliding movement of the spacer sleeve 57A and threaded clutch sleeve section 61 relative to the cylindrical vise screw section 55. The clutch drive member 63 partially fits into an axially extending recess 66 in the outer surface of the vise screw shaft portion 55A and partially lies in the spline like recess 66 on the interior bore of the threaded clutch sleeve section 61.

A plurality of clutch load springs 64 are placed in radial bores in the shaft portion 55A and provide a spring load on the roller 63 radially outwardly to urge the roller 63 into the spline like recess 66 under the threaded sleeve section 61. The recess 66 in the shaft portion 55A is sufficiently deep to permit the detent roller 63 to retract into the recess 66 in the shaft portion 55A so that it will retract from the recess 66 in the sleeve 57, and permit relative rotation between the shaft portion 55A and the threaded clutch sleeve section 61. This permits relative rotation between the shaft portion 55A and the threaded clutch sleeve section 61. The shaft portions 55A and 55 can then rotate to drive rear movable jaw assembly 40 without moving the front movable jaw 30.

The retraction of the roller 63 out of the recess 66 thus disengages the drive from the vise shaft assembly 52 to the front movable jaw assembly 30. The recess 65 will hold the roller 63 in position. The roller also can slide longitudinally relative to the shaft portion 55A, and does slide in the elongated recess 66, so that recess 66 acts like a spline to permit longitudinal movement.

Snap ring 59 is positioned to engage the end of threaded section 61 to prevent axial movement in one direction of the sleeve 57 and the threaded section 61 relative to the shaft portion 55A, beyond the axial position of the snap ring 59.

The movable jaw nuts 30 and 40 are both supported relative to the rails 17 and base plate 12 for sliding movement on surfaces 16 between their open and closed position. Referring to FIG. 8, front vise jaw nut 34 is shown in cross section, and it includes a pair of side shoulders 34B, that extend outwardly from the side and have surfaces 34C that fit underneath upper guide shoulder surfaces 17A of the vise body ways 17. Additionally, the nut 34 has a bottom surface 34D that rides on the top surface of the rail 13. The nut is also guided between the vise body ways 17, as shown, by surfaces 34E. The guiding of the surfaces 34E and 17A, and by the rail 13 permits the nut to slide along the vise body 11 as the front jaw nut 34 is threaded toward and away from the center jaw.

The back nut 44 is guided with side shoulders and rail 13, in the same manner as nut 34, and is operated by threaded section 51. When the vise screw cylindrical section 55 rotates, the back nut 44 and movable jaw assembly 40 will be moved toward or away from the fixed center jaw. The vise screw assembly 52 is mounted in a preload block 75 for some axial movement relative to the vise body 11 at the front end or drive end of the vise screw and is made so that it will automatically preload a workpiece placed in either one of the front or back stations.

The front or drive end of the vise screw assembly 52, and in particular the cylindrical section 55A has a hex drive end 74 thereon for a standard screw crank. This end of the vise screw is supported relative to the vise body in a preload block or vise screw support housing 75 that has shoulders 75A that have upper surfaces 75B which ride on the under surfaces 17A of the vise body ways 17. Additionally, the preload block or vise screw support housing 75 has a surface 75C which rides on the top surface of center rail or guide 13 at this end of the vise body. The preload block or housing 75 can be adjusted to apply braking or drag friction with an adjustment block 80 (see FIGS. 7 and 8) that provides surface 75B against one surface 17A, and is adjusted by wedges 80A and 80B in recess 80C in one shoulder of preload block or vise screw support housing 75. Wedge 80B has a screw 80D that is threaded in the wedge and bears against wedge 80A for adjusting pressure of block 80. The screw 80D is accessed through an opening in a side wall forming recess 80C. The block 80 has inclined bottom surfaces covered with an elastic layer 80E, against which the wedges act. The elastic or compressible layer 80E accommodates some irregularities in the surfaces and maintains a uniform load on block 80. By separating the wedges 80A and 80B with screw 80D, the height of block 80 is raised for adjustment purposes. The wedges are supported on recess end wall 80F and are self-centering in recess 80A and exert no axial load on the preload block or vise screw support housing 75, since no axial wedge loads are applied to block or vise screw support housing 75. Block 80 transmits forces between the two surfaces 17A and the top surface of rail 13 of the vise body. Friction can be created on each surface. The forces are reacted between these three surfaces, so that for examples with a force F on surface 17A from block 80 there will be an equal force F on the other surface 17A and force 2F on the top of central rail 13.

A stop screw 78 is utilized at the front end of the vise body 12 for preventing the housing 75 from moving out of the vise body. A stop screw 78 is also used for preventing the back nut 44 from moving out of that end of the vise body.

The housing 75 is formed with an inner end flange 79, that encircles the outer surface of the sleeve 57, and forms an interior bore or chamber 81. The bore or chamber 81 receives and retains a thrust bearing 83 between flange 79 and the inner end of a spring housing 85.

Figure 4:
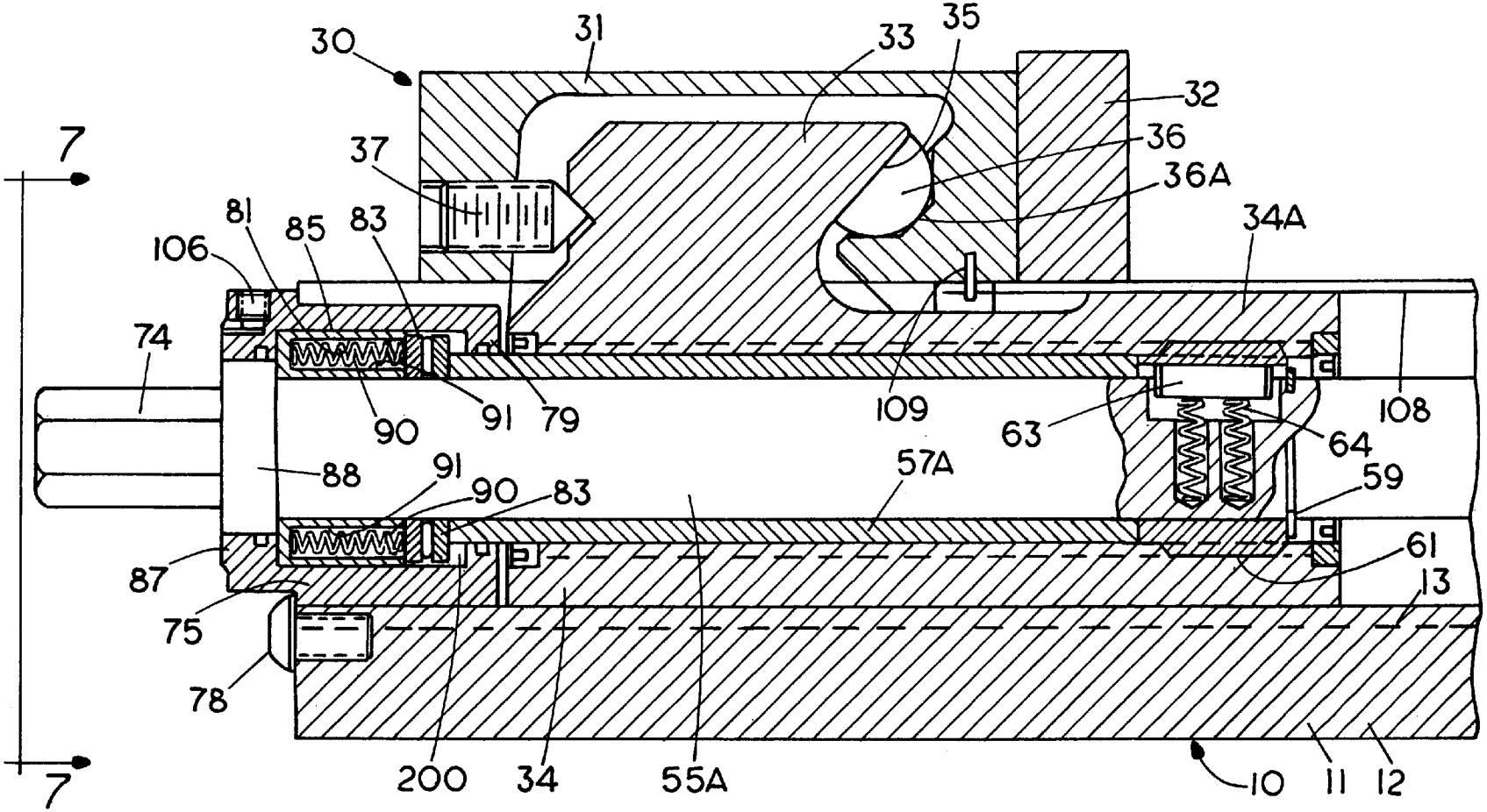
FIG. 4 is a further enlarged sectional view of the spring loading arrangement showing a spring housing in a first position for providing a preload on the front jaws.
Figure 5:
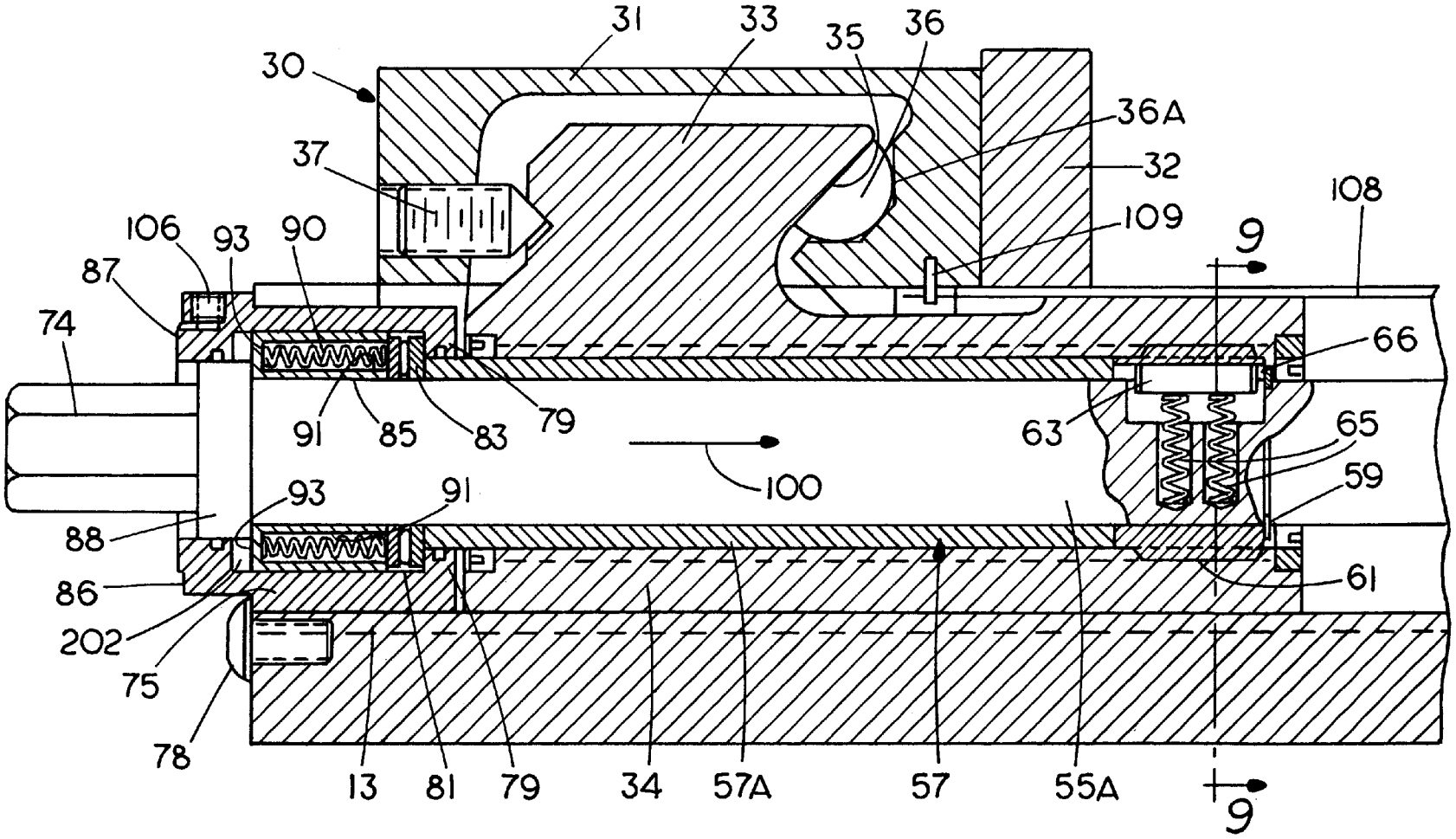
FIG. 5 is a sectional view similar to FIG. 4, but showing the spring housing in a second position for exerting a preload on the rear jaws.
Figure 6:
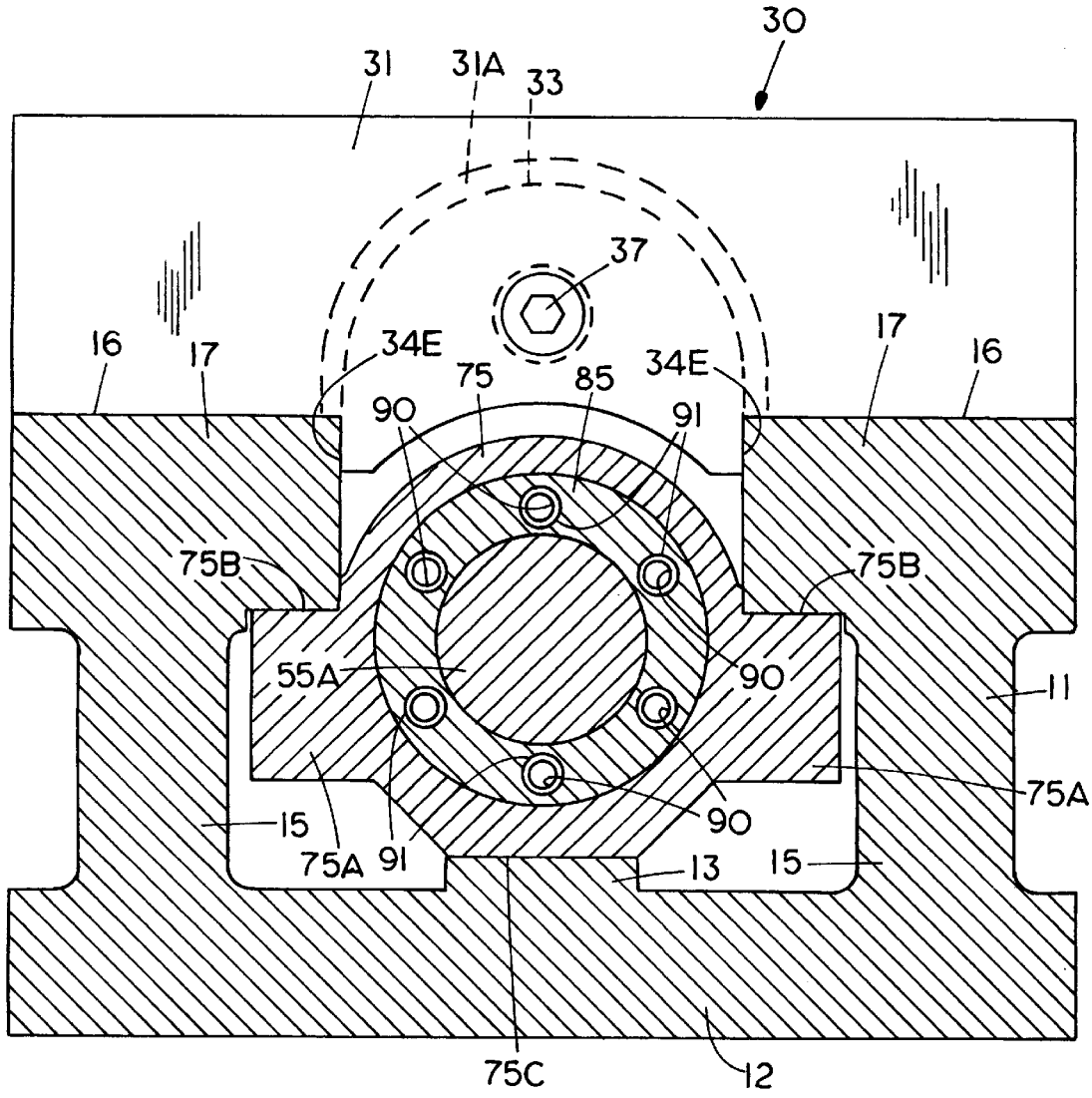
FIG. 6 is a sectional view taken on line 6—6 in FIG. 3.

Spring housing 85 is of shorter length than the space between the thrust bearing 83 and a retainer collar 87 that is threaded into the outer end of the interior bore 81 of the housing 75. The collar 87 seals on a flange 88 on the vise screw portion 55A. The collar 87 forms a keeper collar for keeping housing 85 in chamber 80. The housing 85 carries a plurality of compression springs 90 which are fitted into bores 91 spaced around the periphery of housing 85 (see FIG. 6) and these springs, when not compressed, will extend out from the housing 85 and bear against the thrust bearing 83, as shown in FIG. 3. This is a neutral position. The outer ends of the bores 91 are closed with walls 93 so the springs react loads to the housing. The outer preload block or housing 75 (and thus vise screw assembly 52) can slide inwardly relative to the vise body, and the inner or spring housing 85 can slide relative to the preload block or housing 75 in two directions between the flange 79, and either the collar 87 in the end of bore 81, or an annular shoulder 88 on the vise screw, depending on the loading. In other words the spring housing 85 can slide so the springs 90 are compressed against the thrust bearing 83 as shown in FIG. 4 by movement of the collar 87 toward the thrust bearing, which would cause the sleeve section 57A and threaded clutch sleeve section 61 to slide along the shaft portion 55A, when load on the sleeve 57 which abuts threaded sleeve section 61, is in a direction to compress the springs. The flange 79 is then spaced from the thrust bearing 83 to form a gap 200, as shown in FIG. 4. This gap represents spring 90 compression putting a preload on a workpiece by the front jaw 30. Alternatively, with forces in opposite direction, and a workpiece in the rear jaw, the shoulder 88 and vise screw 52 will move relative to the preload block or housing 75 and will push the spring housing 85 toward the thrust bearing 83 to compress the springs 90. This position is shown in FIG. 5. This forms a gap 202 between the collar 87 and the spring housing compressing springs 90 and causing the spring preload on a workpiece in the rear jaw.

This compression of the springs 90 will provide an automatic spring preload to one or the other of the front or rear jaws.

Tightening the screw (in clockwise direction in FIG. 7) will drive both of the movable jaw assemblies 30 and 40 toward the respective jaw plates of the center fixed jaw 22. Assuming the jaw plate 42 will first contact one workpiece in the rear jaw, as the vise screw assembly 52 and portions 55 and 55A are rotated, the threaded section 51 will exert a force to clamp the workpiece. This puts a tension load in the vise screw causing the shoulder 88 to tend to be pulled in direction as indicated by the arrow 100 in FIG. 5. The springs 90 will be compressed by the shoulder 88 moving the spring housing 85 toward the thrust bearing 83, which is held in the outer housing 75 by flange 79, causing a spring preload on the workpiece by the amount of the spring force, to be exerted onto the workpiece between the jaw plates 42 and 25.

The jaw assembly 30 will continue to be driven by the threaded sleeve section 61 because the clutch roller 63 will not release until the second workpiece is clamped. If the front workpiece will be contacted by the jaw 32 and moved against the jaw plate 24 before the back or rear jaw tightens, the screw threaded sleeve portion 61 reacting on spacer sleeve 57A will move nut 34 to exert a force on the jaw plate 32 tending to clamp the workpiece. The reaction on the end of the spacer sleeve 57A against the thrust bearing 83 will cause the springs 90 to compress. The thrust bearing 83 will move away from the flange 79 of the housing 75. The length of recess 65 permits the clutch roller 63 to slide for this movement. When the preload travel ends, that is, when the thrust bearing 83 contacts the inner end of the spring housing 85 as shown in FIG. 4, by compressing the springs 90, and further tightening of the vise screw is done, the clutch roller 63 will retract against the springs 64 and the cylindrical shaft portion 55A of the vise screw will rotate inside the threaded clutch sleeve section 61. The clutch sleeve section 61 has a cam like recess 57B which receives the roller 63 after the roller releases so the screw portions 55 and 55A are free to rotate. The vise screw can be rotated until the workpiece in the back jaws, between plates 25 and 42 is clamped. The front jaw load is transmitted from threaded section 51 through shoulder 88 to the movable jaw housing 31. The movement of the spacer sleeve 57A and threaded clutch sleeve section 61 along the shaft 55 is accommodated by the spline like recess 66 in the sleeve, that permits the roller 63 to slide along the clutch sleeve section 61 without releasing the clutch. The spacer sleeve 57A and threaded sleeve section 61 carry axial loads between the thrust bearing 83 and the front vise nut 34.

The amount of preload travel can be adjusted by changing the setting of adjustable collar 87 which is threaded into the preload block or housing 75 in the interior of the chamber bore 81, so that the at rest position of the spring housing 85 can be changed relative to the thrust bearing 83 by compressing the springs 90 more or less. A set screw 106 that can be threaded to fit into a recess in the collar can be used for locking the collar 87 in position. The annular shoulder 88 is not affected by this adjustment movement, and slides relative to the collar 87.

If uneven size workpieces are clamped, the back station or set of jaws is used to hold the larger size in the form of the vise shown. The reason is that movement of the preload block 75 is permitted only toward the center jaw from a centered position. If the vise body was longer, so preload block 75 could slide farther to the left in FIGS. 2–5, then the larger part could be placed in either the front or rear jaws. With a larger part in the rear jaws, when the screw is rotated in clamping direction the front jaw 30 will be driven by the threaded clutch sleeve portion 61 through the clutch roller 63, drawing the sliding preload block or housing 75 along the vise body until the part in the front jaws is engaged, and clamped, after which this clutch will slip. As the clutch slips, the back jaw or jaw assembly 40 will be threaded while the screw is being turned to securely clamp both of the parts or workpieces.

The smaller part or workpiece always is in the front station, and the larger part in the back station. The housing 75 will slide inwardly along the base 12, as the threaded section 51 would move inwardly along the threaded hub 44A of the nut 44. The inward sliding is one-half of the distance the front jaw travels after the part in the rear jaw is preclamped when first set up.

Figure 12:
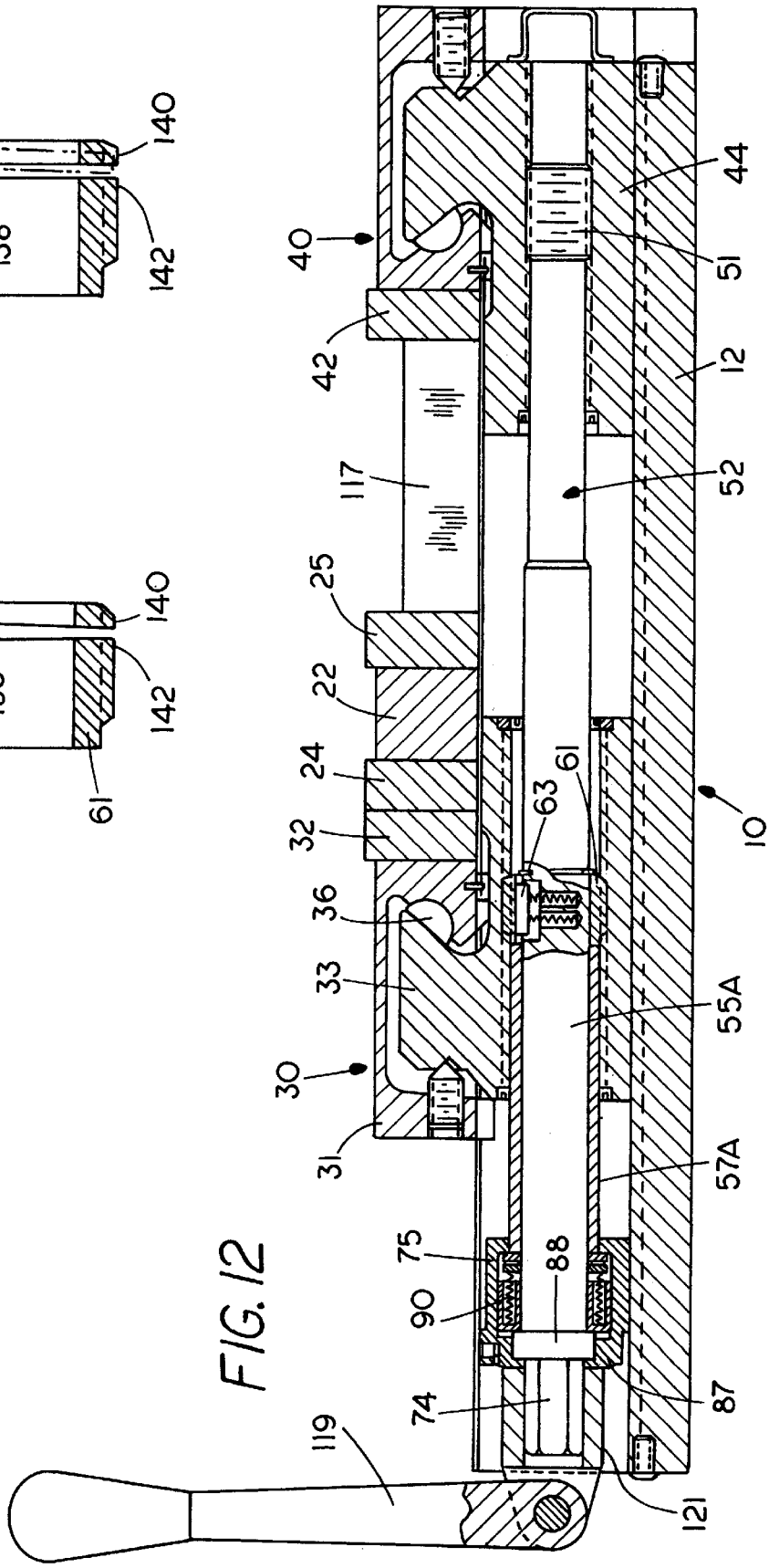
FIG. 12 is a sectional view of the vise showing the travel of a preload block with the jaws positioned with the back jaw is at its maximum clamping size and the front jaws closed with no workpiece.

FIG. 12 illustrates the position of the support housing 75 with a maximum size workpiece 107 engaged by the back movable jaw 40 with a very thin or no workpiece in the front jaws. On initial setup the workpiece 107 will be contacted by jaw plate 42 and as the screw is rotated threaded section 51 will move along the threads in jaw 44 from the position of FIG. 2, pulling nut jaw 30 toward the center and also sliding support housing 75 inwardly along the vise body. At the same time, while screw 52 is being turned, threaded clutch sleeve 61 will drive the nut 34 and jaw 30 toward the center fixed jaw. Thus the support housing 75 has to slide inwardly only one-half the length of the difference in travel of between jaw 30 and jaw 40. The showing in FIG. 12 illustrates that even with maximum difference, the housing 75 moves into the vise body a minimum distance and a standard vise handle 119 with a standard length drive hub 121 can be used.

The double thread drive for accommodating different size parts automatically adjusts. Note in FIG. 12 that the threaded clutch section 61 is inwardly from the inner or back end of the nut 34.

In order to shield the open top between the rail portions 17 from chips, telescoping sheet metal or other thin material shields are utilized. There are three sections of such shields. The center section, which can be seen in FIG. 1 at 105, has side tabs that are clamped underneath the fixed jaw, and there are two center shield sections 105A and 105B that extend to the front and the rear respectively for a short distance between rails 17. The distance is indicated at 106 in FIG. 1.

Figure 1:
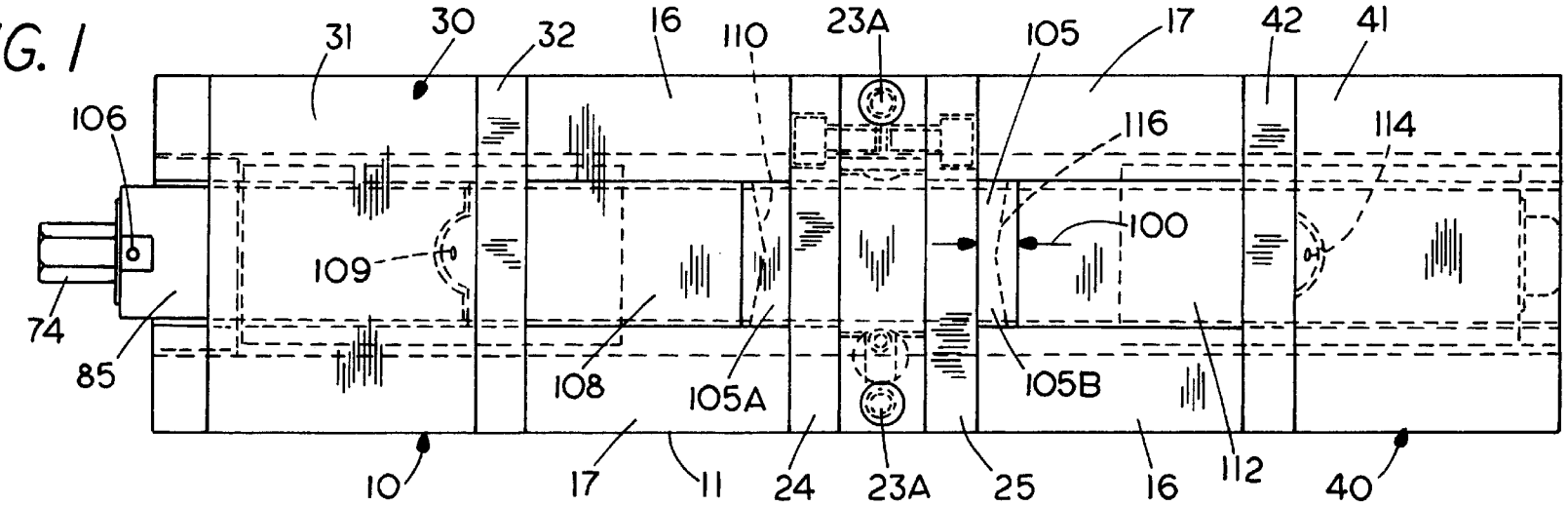
FIG. 1 is a top plan view of a vise made according to the present invention showing the jaws in a first position substantially equally spaced from a center block.

A front jaw shield section 108 is pinned with a suitable pin 109 to the front jaw body 31, so that section 108 travels with the jaw body. When the front jaws at its farthest open position as shown in FIG. 1, the end of the shield section 108 indicated by line 110 is underneath the center shield section 105A and is between the rails 17. A recess or guide groove 17G is provided on each way or rail 17 for supporting the edges of the shield section 108 for sliding movement. It can be seen that shield section 108 has a tapered end, and thus will tend to guide itself past the shield section carried on the rear jaw.

The rear jaw body 41 has a shield section 112 attached thereto with a pin 114. The shield section 112 extends between the rails 17, below the plane of surfaces 16 and is supported in guide grooves 17G as well. The shield section 112 is positioned below the plane of way surfaces 16. The shield sections 108 and 112 also rest on the top of the respective jaw nuts for the front and rear jaw. The shield section 112 has a tapered end portion shown in dotted lines at 116 that also is positioned under the center shield portion 105 when the rear jaw is in its full open position. As the movable jaws close, the end portions 110 and 116 of the shield members will move toward each other, and slide under the shield portions 105A and 105B. When the shield section 108 and 112 come so that their ends 110 and 116 are adjacent and move together, the tapered end portions will cause one or the other of the shield sections to ride up on top of the opposite shield section and telescope together, to permit the jaws to close without damaging the shield sections. The leading edge of the end portion also can be beveled from the plane of the shield sections to aid in guiding the shield sections to slide past one another. The jaws can move to the position shown in FIG. 9 where the shield members 108 and 112 are overlapping underneath the center shield section 105, with both movable jaws in the fully closed position.

The shield sections form a chip shield that is effective as the jaws separate, and any chips or the like from machining a workpiece held in the jaws will not fall down onto the vise screw and other working parts.

Figure 11:
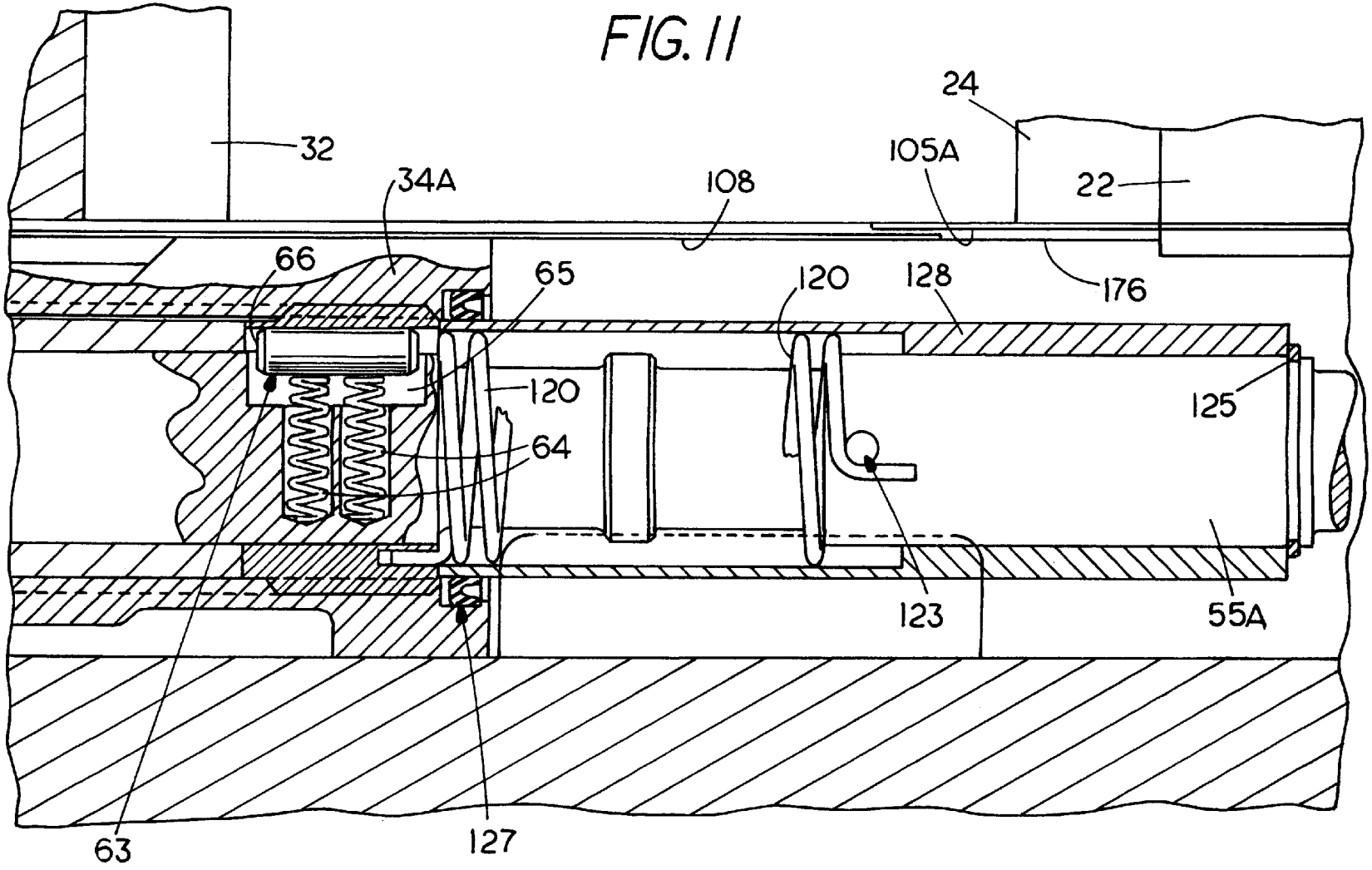
FIG. 11 is a sectional view of the vise showing a torsion spring that creates a load on the clutch when the clutch releases to aid in resetting of the clutch to its engaged position.

In certain instances, it is desirable to have a load between the vise screw portion 55A and the clutch sleeve portion 61, to insure that the operation is controlled appropriately, and as shown schematically, a torsion spring 120 can be mounted around screw portion 55A with one end anchored to the screw portion 55A with a pin 123, and the other end anchored to the clutch sleeve section 61 in a suitable manner at 122, as shown in FIG. 11. The effective axial length of the sleeve assembly 57 of spacer sleeve section 57A and sleeve section 61 preferably is extended by removing snap ring 59 and placing a snap ring 125 near the inner end of screw shaft section 55A. A sleeve extension 128 is slidably mounted over the shaft section 55A and extends to abut the end of threaded sleeve section 61, so axial forces on the preload block are reacted to the vise screw through the sleeve assembly formed by spacer sleeve 57A, threaded sleeve section 61 and sleeve section 128. The sleeve section 128 is recessed to provide clearance for torsion spring 120. A seal 127 is also used, as in other forms of the invention.

Figure 9:
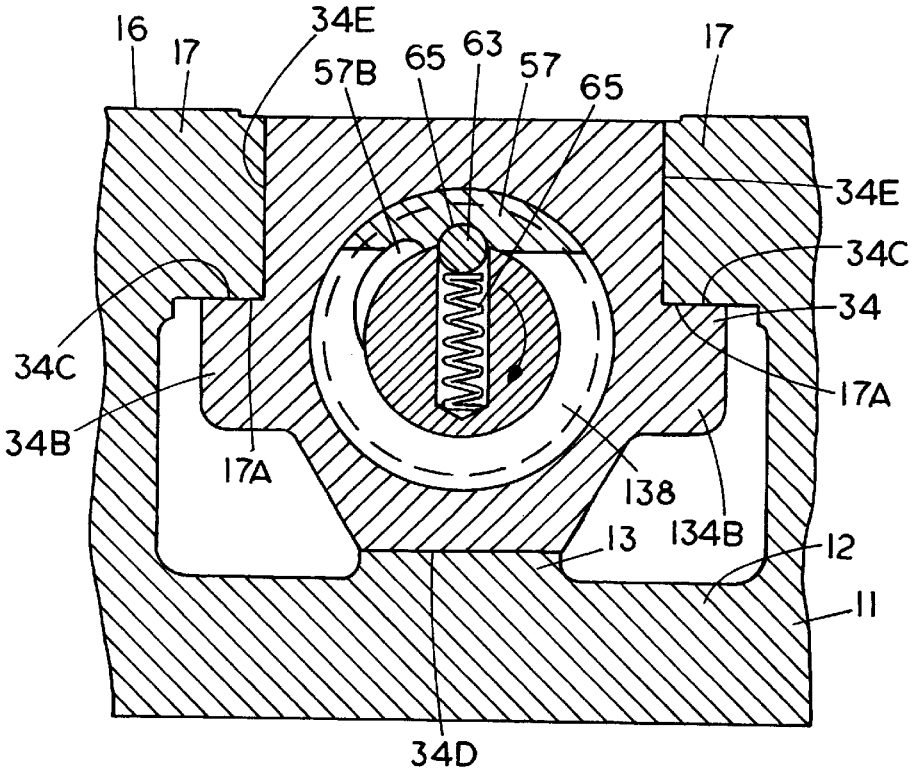
FIG. 9 is an enlarged sectional view of the clutch arrangement shown for driving the screw that operates the front jaw.
Figure 10:
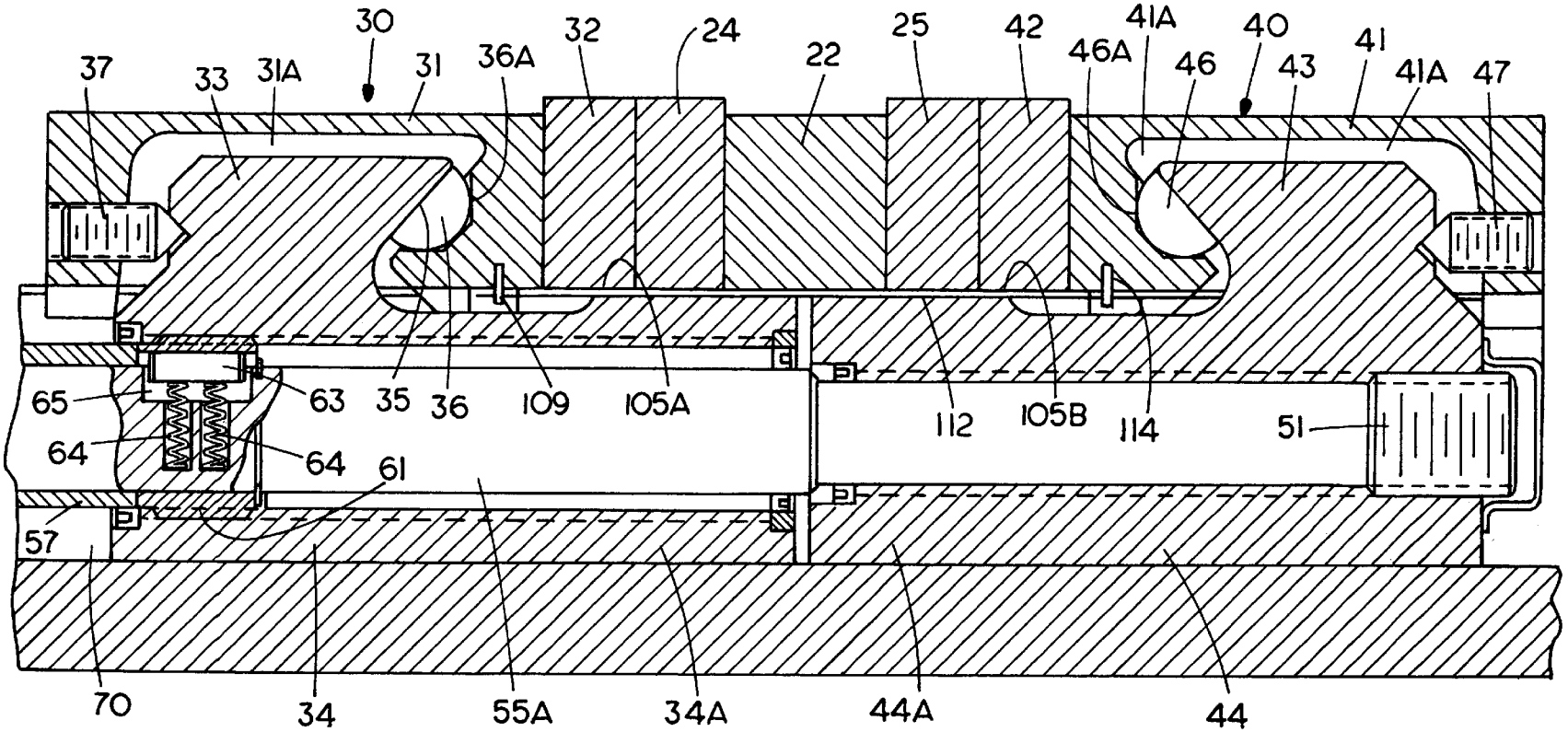
FIG. 10 is an enlarged sectional view showing a chip shield used with a double jaw vise.
Figure 14:
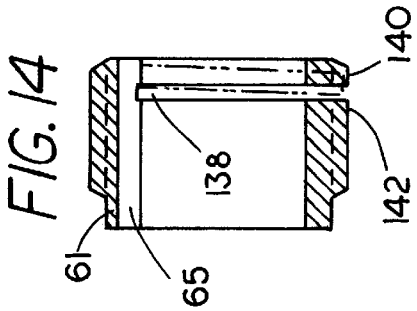
FIG. 14 is a side view of the clutch sleeve of FIG. 13 in working position.
Figure 13:
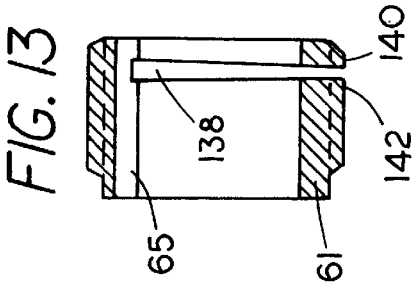
FIG. 13 is a side view of a modified clutch sleeve section that provides an alternate braking action on the threads of the mating jaw nut to permit reliable resetting of the clutch.

A friction brake that places a drag between the front clutch nut 34 and the threaded clutch sleeve section 61 to insure the screw shaft 55 will rotate in the clutch sleeve 61 to reset the clutch is shown in FIGS. 9, 13 and 14.

Clutch sleeve 61 can be modified to have a saw cut 138 extending across the center bore so one thread 140 severed from the hub portion 140 bent inward toward an adjacent thread 142 as shown in FIG. 13. The saw cut is shown in FIG. 9 also. The severed length is thus resiliently loaded. The thread 40 will mate with the threads in the hub 34 as the clutch sleeve section 61 drives the hub and resiliently moves to the position shown in FIG. 13. This creates a friction load between the clutch sleeve 61 and hub 34. When the clutch releases and is to be reset, the friction brake from bent thread section 140 will frictionally resist movement between the clutch sleeve 61 and jaw nut hub 34 so the screw 52 can be rotated in the clutch sleeve 61 to reset the clutch roller back to its drive position.

A resilient plug (such as a nylon plug) also can be inserted in a bore formed in clutch hub 61 to protrude to engage the edges of threads in the movable jaw hub 34 to provide a braking action.

The torsion spring 120 tends to tighten as the clutch assembly 60 slips and there is relative rotation between the screw portion 55A and the spacer sleeve 57A and clutch sleeve 61. The spring 120 provides a bias force tending to urge the vise screw 55 and clutch sleeve 61 to reverse and rotate back to the operative position.

Although the present invention has been described with reference to preferred embodiments, workers skilled in the art will recognize that changes may be made in form and detail without departing from the spirit and scope of the invention.

What is claimed is:

1. A double vise assembly having a base supporting a center fixed jaw, and first and second movable jaws, movable toward and away from the fixed jaw on opposite sides of the fixed jaw, a vise screw for actuating the movable jaws including a threaded section threadably mounted in the second jaw, and a threaded clutch sleeve section threadably engaging the first jaw, said vise screw including a shoulder, a housing slidable on the vise screw, and a spring carried on the vise screw and reacting axial loads between the clutch sleeve section and the shoulder, the spring being compressed upon initial contact of either one of said movable jaws for clamping a workpiece to preload such workpiece, and a release coupling between the threaded clutch sleeve section and the vise screw to permit tightening the second jaw to a predetermined force level and subsequently releasing to permit the screw to rotate and be threaded relative to the first jaw.

2. The double vise of claim 1, wherein there is a spring housing on the vise screw abutting the shoulder, said spring being mounted in a bore in the spring housing and extending out of the spring housing, and a thrust carrying member to react spring forces between the shoulder and the threaded clutch sleeve section.

3. The double vise of claim 2, wherein said spring housing supports a plurality of springs providing force parallel to a longitudinal axis of the vise screw between the reaction shoulder and the threaded clutch sleeve section.

4. The double vise of claim 3 wherein there is a screw support housing slidably supporting a first end of the vise screw on the base, the spring housing being mounted in a chamber of the screw support housing.

5. The double vise of claim 4, wherein said vise base supports a pair of vise body ways with spaced apart surfaces that face the base, a guide rail centered on the base and extending longitudinally along the vise base, said screw support housing having a pair of shoulders that engage and slidably move on undersurfaces of the vise body ways, and a surface sliding on the guide rail.

6. The double vise of claim 5 and a adjustment block for applying loads mounted in one of the shoulders of the screw support housing and being adjustable in and out relative to one of the sufaces of one of the vise ways.

7. The double vise of claim 1, wherein said release coupling comprises a roller on the vise screw received in a longitudinally extending recess in the threaded clutch sleeve section, said recess in said threaded clutch sleeve having a length greater than the length of the roller such that the threaded clutch sleeve can slide axially on the vise screw a selected amount with the roller positioned in the recess.

8. The double vise of claim 3 and an adjustment collar on the spring housing for adjusting the preload travel.

9. The double vise of claim 1 and a separate telescoping shield with a pointed nose carried by each of the movable vise jaws, and a center overlying shield mounted on the center block, said telescoping shield members sliding relative to the overlying shield and relative to each other as the movable vise jaws move between open and closed positions.

10. The double vise of claim 1 and an element connected to provide a force when the release coupling has released the clutch sleeve from driving engagement with the screw to resist rotation of the vise clutch sleeve relative to the jaw nut in a direction opposite from the release direction of the screw.

11. The vise assembly of claim 1 further comprising a roller release clutch between said first threaded section and said vise screw, said roller release clutch being mounted on said vise screw and spring loaded outwardly, and said first threaded section having a longitudinally extending recess for receiving said roller, said roller moving out of said recess against said spring load to a position within the periphery of said vise screw when torque on said vise screw exceeds a preset level.

12. The vise assembly of claim 11, wherein said recess in said first threaded section is elongated in a longitudinal direction to an extent longer than the roller.

13. A double vise with self-setting clamping jaw openings with the same or different size workpieces comprising a vise base, a pair of spaced apart ways supported on said base and having coplanar surfaces, a fixed jaw mounted on said base, a first jaw slidably mounted on said ways and movable toward one side of the fixed jaw, a second jaw mounted on said ways and movable toward and away from a second side of said fixed jaw, said first and second movable jaws each having a separate nut with internal threads, a vise screw having a first threaded section threadably mounted in said first jaw nut and being releasably coupled for releasable rotational movement relative to the vise screw, a second threaded section fixed to said vise screw and threadably mounted in said second jaw, a vise screw support housing slidably mounted on said vise base at a first end of the vise adjacent said first movable jaw, said vise screw being rotatably mounted in said vise screw support housing, a plurality of springs mounted within said vise screw support housing and having axial lengths parallel to an axis of rotation of said vise screw, said springs reacting against a shoulder on the vise screw at an outer end of said vise screw that is within the vise screw support housing, and a compression carrying load member between ends of said springs opposite from the ends of the springs engaging the shoulder, and said first screw threaded section, said first screw threaded section being slidable along said screw for a limited distance.

14. The vise assembly of claim 13, wherein said vise screw support housing has a pair of shoulders extending laterally therefrom, said ways having surfaces on a lower side thereof to be engaged by said vise screw support housing shoulders, and said vise screw support housing having a support surface slidably mounted on said base for longitudinal movement along said base.

15. The vise assembly of claim 14 and an adjustment block mounted in one of said shoulders of said vise screw support housing, said adjustment block providing a surface of the one shoulder that engages the undersurface of a way, and a pair of wedges acting on said adjustment block to move said adjustment block relative to the one shoulder to change the height of the surface of the one shoulder engaging the way, said wedges being adjustable toward and away from each other to provide for sliding engagement with tapered mating surfaces on said adjustment block.

16. The vise assembly of claim 15, wherein said adjustment block comprises a sliding block slidably mounted in a recess the one of the shoulders of the screw support housing, said sliding block having downwardly facing surfaces that are inclined relative to a central axis downwardly from a plane parallel to the lower surfaces of the ways, a pair of wedge members that are spaced apart and received in the recess in the one shoulder, and which have surfaces complimentary to the downwardly facing surfaces on the sliding block, a screw rotatably mounted in one of said wedge members to react loads of the other of said wedge members to tend to separate the wedge members and to move the wedge surfaces toward the downwardly facing surfaces of the sliding block, and a resilient layer of material between the wedge members and the downwardly facing surfaces to be engaged by the wedge members and urged against the downwardly facing surfaces when the wedge members are separated to urge the sliding block toward the lower surfaces of the ways.

17. The vise assembly of claim 13 and a stop member on said vise screw to prevent the first threaded section from moving along said vise screw in a direction away from said shoulder beyond a selected position.

18. The vise assembly of claim 13, wherein said plurality of springs are mounted in a separate spring housing rotatably mounted in a bore in the screw support housing, said separate spring housing having an end wall bearing against the shoulder, said springs extending outwardly from said spring housing in an opposite direction from the shoulder to provide a spring load against said axial load carrying member.

19. The vise assembly of claim 18, wherein said screw support housing interior bore is of length to permit axial sliding movement of said spring housing relative to the screw support housing.

20. The vise assembly of claim 19 and a threaded collar threadably mounted on an interior bore of said vise screw support housing for adjusting a stopped position of the spring housing toward an exterior end of said vise screw support housing.

21. The vise assembly of claim 13, wherein said axially load carrying member comprises a sleeve section surrounding said vise screw and carrying axial loads from said springs to said first threaded section.

22. The vise assembly of claim 21 and a thrust bearing between said sleeve section and said springs, said springs bearing directly against said thrust bearing.

23. The vise assembly of claim 13 and a fixed shield member mounted on said ways and being positioned between said ways beneath the fixed jaw, said fixed shield member extending outwardly between the ways on both sides of said fixed jaw, and a separate movable shield member mounted on each of said movable jaws between the ways and telescoping under said fixed shield member on said fixed jaw when the respective movable jaw is moved toward and away from the fixed jaw.

24. The vise assembly of claim 23, wherein said separate shield members carried on said movable jaws have ends that are tapered to permit the separate shield members on said movable jaws to slide past each other as the movable jaws move toward the fixed jaw.

25. A machine vise adapted to hold two workpieces, and automatically adjust for workpieces of different size to be clamped relative to a fixed reference location, said vise comprising a body, a fixed jaw mounted on said body at a location spaced from both of opposite ends of the body, and having oppositely facing surfaces, a jaw actuator comprising a vise screw mounted on said base and having first and second screw thread sections thereon, said screw thread sections being of opposite direction lead, and first and second movable jaws threadably mounted on said first and second thread sections of said vise screw, respectively, and slidably mounted on said body to move a respective workpiece toward a different one of the oppositely facing surface of the fixed jaw, respectively, said first screw thread section being rotatably mounted on said vise screw and rotatably driven through a releasable clutch that releases when torque exerted by said vise screw on said first thread section exceeds a selected amount, the second screw section being rotationally fixed on the vise screw, a vise screw support housing slidably mounted on said body and supporting a first end of said vise screw adjacent a first end of said body, an annular shoulder on said vise screw adjacent the first end of said vise screw and slidably mounted in said body, and a spring assembly including a plurality of springs, each having one end that engages said shoulder when under compression, and opposite ends which are positioned to provide an axial force on said first thread section, said springs being compressible when there is relative movement between said screw support housing and said vise screw in each of opposite directions acting along a longitudinal axis of said vise screw to provide a preload on one of the first and second jaws which first engages a workpiece and causes the vise screw clutch to release the first vise screw section until the other of the first and second jaws engages a workpiece and tightens against the fixed jaw.

26. A vise assembly having a body with a sliding housing sliding on guide surfaces on the body, the housing including a pair of shoulders for supporting loads in a first direction and a support surface reacting loads in a second opposite direction, an adjustable block assembly self-contained in one of the shoulders including a block slidably mounted in a recess in one of the shoulders of the sliding housing, said block having a support surface engaging a guide surface on the vise body and a pair of surfaces that are inclined relative to a central plane and extending in opposite direction from the support surfaces, a pair of wedge members in the recess and slidably supported on an interior end surface of the recess, the wedge members having surfaces complimentary to the downwardly facing surfaces on the adjustment block, a screw rotatably mounted in one of said wedge members to react loads of the other of said wedge members to separate the wedge members and to move the wedge surfaces toward the inclined surfaces of the block, and a resilient layer of material between the wedge members and the inclined surfaces to be engaged by the wedge members and urged against the inclined surfaces when the wedge members are separated to tend to move the block out of the recess.

* * * * *